United States Patent [19]

Brünger et al.

[11] 4,258,283

[45] Mar. 24, 1981

[54] CATHODE FOR ELECTRON EMISSION

[75] Inventors: Wilhelm Brünger; Gottfried Möllenstedt, both of Tübingen, Fed. Rep. of Germany

[73] Assignee: Balzers Aktiengesellschaft für Hochvakuumtechnik und Dünne Schichten, Liechtenstein

[21] Appl. No.: 938,333

[22] Filed: Aug. 31, 1978 (Under 37 CFR 1.47)

[51] Int. Cl.[3] ..... H01J 1/16; H01J 19/10

[52] U.S. Cl. ..... 313/336; 313/346 R

[58] Field of Search ..... 313/336, 346

[56] References Cited

U.S. PATENT DOCUMENTS

| | | | |
|---|---|---|---|
| 3,312,856 | 4/1967 | Lafferty et al. | 313/346 R |
| 3,532,923 | 10/1970 | Vogel | 313/336 X |
| 3,631,291 | 12/1971 | Favreau | 313/336 |
| 3,823,337 | 7/1974 | Van Stratum et al. | 313/346 R |
| 3,928,783 | 12/1975 | Hosoki et al. | 313/346 R |
| 4,054,946 | 10/1977 | Ferris et al. | 313/336 |
| 4,055,780 | 10/1977 | Kawai et al. | 313/336 |
| 4,068,145 | 1/1978 | Nakagawa et al. | 313/336 |
| 4,137,476 | 1/1979 | Ishii et al. | 313/336 |

*Primary Examiner*—Saxfield Chatmon, Jr.
*Attorney, Agent, or Firm*—McGlew and Tuttle

[57] ABSTRACT

A cathode assembly for electron emission, comprises, a heatable support of a high-temperature resistant material, an emitter body of lanthanum hexaboride, and an auxiliary body having a surface contact with both the support and the emitter body, which is made of a third material, comprising a sintered material of the class of carbides, nitrides and borides. The surface contact area between the auxiliary body and the support amounts to at least 1/6 of the surface area of the emitter body.

1 Claim, 4 Drawing Figures

CATHODE FOR ELECTRON EMISSION

FIELD AND BACKGROUND OF THE INVENTION

This invention relates to the construction of electron emission cathodes in general and, in particular, to a new and useful cathode assembly for electron emission, comprising, a rod-shaped electron emitter of lanthanum hexaboride ($LaB_6$), which is joined to a heatable support by an auxiliary body.

DESCRIPTION OF THE PRIOR ART

As is well known, $LaB_6$ emitters have the advantage of a high emission current density at relatively low operating temperatures. In particular, thermionic emitters of lanthanum hexaboride monocrystals permit very high emission current densities of up to 100 amp per $cm^2$. However, the mounting of the emitter is difficult.

The securing of rod-shaped emitters of $LaB_6$ to a heating wire of tantalum, for example, directly by welding is known. However, the life of such cathodes is limited because of the reaction between the heating wire metal and the very avidly reactive $LaB_6$. To forestall this reaction, it has already been proposed to clamp a cathode tip of $LaB_6$ between two graphite jaws which are heated by a direct passage of current. This solution, however, again entails difficulties in view of the operating temperature which is required. Due to the unequal thermal expansion of the different parts of the mount, an unduly high drift of the cathode is to be expected in many electron-optical devices.

SUMMARY OF THE INVENTION

The present invention provides a novel construction of a lanthanum hexaboride cathode which not only exhibits a substantially improved mechanical stability, but also a longer life.

The inventive cathode for electron emission, including a heatable support of a high-temperature resistant material and having an emitter body of lanthanum hexaboride, is characterized in that an auxiliary body of a third material is provided having a surface contact with both the support and the emitter body. By providing the auxiliary body, a quite satisfactory mounting and heat transmission are obtained which are independent of any possible reactions between the heating wire and the $LaB_6$, even in instances where the emitter rod contacts the metal of the heating wire directly, because in this latter case, even though the contact area may corrode, a reliable heat transmitting connection between the heating wire and the emitter, through the auxiliary body, is maintained.

Particularly suitable materials for the auxiliary body are, for example, sintered materials of the class of carbides, nitrides and borides. It is advisable to provide the extent of the contact area between the auxiliary body and the support, and the auxiliary body and the emitter body, at least equal to 1/6 of the surface area of the emitter body, in order to ensure a satisfactory heat transmission and mechanical stability. The emitter body may be designed in various shapes, for example, in the form of a rod or block, or of a cone with an emitting tip. By emitter body, however, no mere $LaB_6$ coatings or layers deposited on a heating wire (which also has already been proposed) are to be understood within the scope of the present specification.

It is advantageous to design rod-shaped emitter bodies to have a portion of the length of the emitter body embraced by the auxiliary body, or to have one of its ends embedded in the auxiliary body.

Accordingly, it is an object of the invention to provide a cathode assembly for electron emission which comprises a heatable support, such as an electrical heating wire, of a high-temperature resistant material, an emitter body of lanthanum hexaboride and an auxiliary body having a surface contact with both the support and the emitter body, and being made of a third material.

A further object of the invention is to provide a cathode assembly for electron emission, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

DESCRIPTION OF THE PREFERRED EMBODIMENTS

Figure 1:
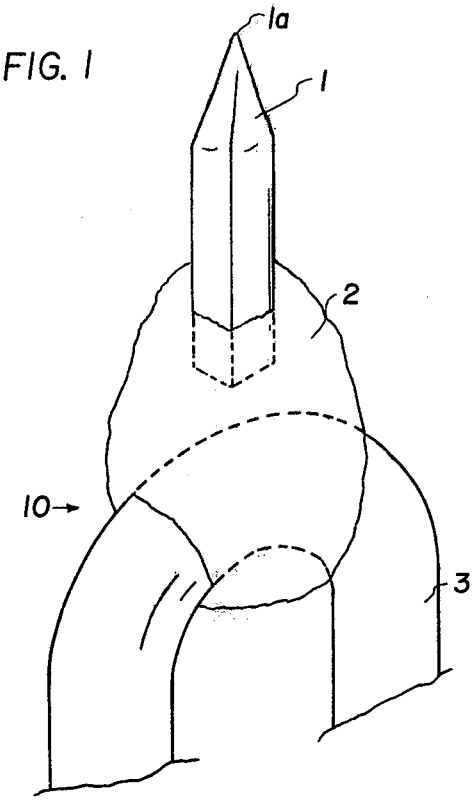
FIG. 1 is a partial perspective view of a cathode assembly, constructed in accordance with the invention.

Referring to the drawing in particular, the invention embodied therein, comprises, a cathode assembly, generally designated 10, which, as shown in FIG. 1, comprises an electrical heating resistance wire 3 forming a heatable support of a high-temperature resistance material and an emitter body or emitter rod 1 of lanthanum hexaboride ($LaB_6$) which is mounted to heating wire 3 by an auxiliary body 2 comprising a sintered material of a carbide, nitride or boride. The emitter body 1 may comprise a rod, block or a cone having an emitter tip 1*a*.

Emitter body 1 advantageously comprises a solid piece of lanthanum hexaboride, rather than a base with a coating of lanthanum hexaboride. The emitter rod 1 is advantageously embedded in the auxiliary body material 2, as is a portion of the heating wire 3.

Figure 2:
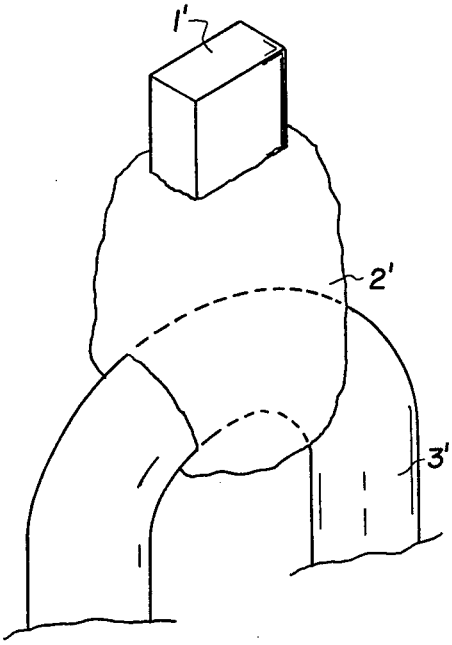
FIG. 2 and FIG. 3 are views similar to FIG. 1, of other embodiments of the invention.
Figure 3:
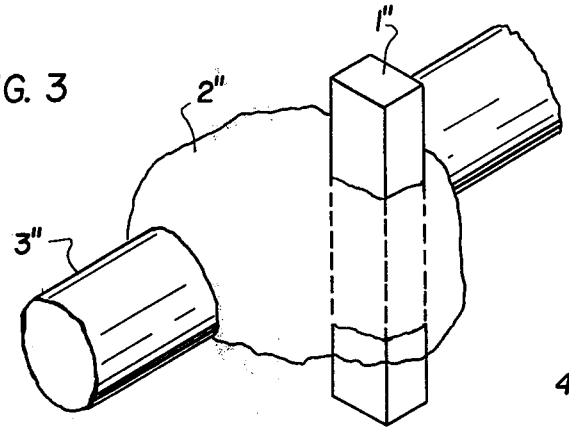

FIGS. 1, 2 and 3 all show lanthanum hexaboride hot cathodes in which emitter rods 1, 1' and 1'' are embedded in respective auxiliary bodies 2, 2' and 2''. The heat necessary for heating the emitter rods 1, 1' and 1'' to the required operating temperature is transmitted through the auxiliary bodies 2, 2' or 2'' from a respective heating wire 3, 3' and 3''. The material for the auxiliary body 2 is advantageously selected so as to minimize its reaction with the metal of the heating wire and with the $LaB_6$. In this regard, tantalum carbide has proven to be particularly suitable.

The emitter rod 1 may be made of a single crystal or a polycrystalline $LaB_6$. There is no need for the auxiliary body to completely enclose an emitter body portion. It is important, however, to have a sufficiently large contact area between the auxiliary body and the emitter body. This applies particularly to auxiliary bodies made of materials which tend to disentegrate, for example, by decarburization, under the effect of the operating vacuum in electron beam apparatus. Experience has shown that not only the outside of the auxiliary body exposed to the vacuum may suffer such a disintegration, but that also the contact surface between the auxiliary body and the emitter is attacked, progressively from the outside inwardly. However, this attack, which is probably due to a reaction between the two materials, progresses at a substantially slower rate than corrosion of the junction between the $LaB_6$ and a metallic heating wire. Thus, the invention makes it possible to use such materials of the class of carbides, nitrides, and borides for the auxiliary body which, in themselves, are not stable in vacuum, and, despite this, to obtain a substantially extended life of the $LaB_6$ mounting relative to the prior art arrangements, due to this special inventive construction.

The simplest way of producing the auxiliary body and of joining it to the support, on the one hand, and to the emitter body, on the other hand, is to mix the respective pulverized starting material, for example, tantalum carbide powder, with water or alcohol to a paste, and then to cement the emitter body to the support, as shown in each figure of the drawing. By heating and sintering the auxiliary body, a mechanically strong union between the parts can thereupon be accomplished.

Figure 4:
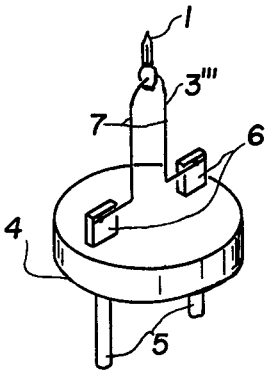
FIG. 4 is a top perspective view of a cathode plug.

FIG. 4 shows the arrangement of an inventive cathode on a plug 4. The cathode assembly may be fixed to the legs 7 of a heating wire 3''' in clamps 6 which are electrically connected to the plug pins 5. With a suitable dimensioning of the plug and the electrical resistance of the heating wire, the arrangement shown may directly replace the tungsten cathodes hitherto frequently used in electron beam apparatus.

While specific embodiments of the invention have been shown and described in detail to illustrate the application of the principles of the invention, it will be understood that the invention may be embodied otherwise without departing from such principles.

What is claimed is:

1. A cathode assembly for electron emission, comprising: a heatable support of a high temperature resistant wire; a rod-shaped emitter body of solid lanthanum hexaboride; and an auxiliary body having a surface contact with both the support and the emitter body and being made of sintered tantalum carbide; said auxiliary body embracing said emitter body along a portion of the length thereof at one end of said emitter body which is embedded in said auxiliary body; the surface contact area between said auxiliary body and said support amounting to at least 1/6 of the surface area of said emitter body and said auxiliary body and said emitter body have a surface contact area therebetween amounting to at least 1/6 of the surface area of said emitter body.

* * * * *